US007152279B2

(12) United States Patent
Elliott

(10) Patent No.: US 7,152,279 B2
(45) Date of Patent: Dec. 26, 2006

(54) TOWEL ATTACHMENT DEVICE

(76) Inventor: Paul Elliott, 12 Cove Dr., Sound Beach, NY (US) 11789

( * ) Notice: Subject to any disclaimer, the term of this patent is extended or adjusted under 35 U.S.C. 154(b) by 0 days.

(21) Appl. No.: 09/900,923

(22) Filed: Jul. 9, 2001

(65) Prior Publication Data

US 2001/0037542 A1 Nov. 8, 2001

Related U.S. Application Data

(63) Continuation-in-part of application No. 09/370,616, filed on Aug. 7, 1999, now Pat. No. 6,256,840.

(51) Int. Cl.
*A63B 57/00* (2006.01)

(52) U.S. Cl. ..... 24/3.1

(58) Field of Classification Search ..... 24/3.1, 24/8, 3.12, 3.6; 224/268, 269; D6/608; 15/208, 209.1, 210.1, 105, 118; 206/315.3, 206/315.5; 428/82, 85

See application file for complete search history.

(56) References Cited

U.S. PATENT DOCUMENTS

| | | | | | |
|---|---|---|---|---|---|
| 3,563,430 | A | * | 2/1971 | Forrest | 224/255 |
| 4,516,616 | A | * | 5/1985 | Fesler | 15/209.1 |
| 4,912,800 | A | * | 4/1990 | Zeltner | 15/114 |
| D339,951 | S | * | 10/1993 | Parkison et al. | D6/608 |
| 5,331,705 | A | * | 7/1994 | Melov | 15/118 |
| 5,407,723 | A | * | 4/1995 | Curtin | 428/124 |
| 5,433,339 | A | * | 7/1995 | Sarver | 220/756 |
| 5,450,954 | A | * | 9/1995 | Dunn | 206/315.3 |
| 5,540,367 | A | * | 7/1996 | Kauker | 224/180 |
| 5,577,304 | A | * | 11/1996 | Simond | 24/588.1 |
| D384,717 | S | * | 10/1997 | Hodges | D6/608 |
| 5,770,284 | A | * | 6/1998 | Logemann | 15/210.1 |
| 5,771,523 | A | * | 6/1998 | Rudolph | 15/209.1 |
| 5,898,968 | A | * | 5/1999 | Beattie | 15/210.1 |
| 5,927,489 | A | * | 7/1999 | Carswell | 206/315.1 |
| D412,422 | S | * | 8/1999 | Cobb | D6/608 |
| 6,062,521 | A | * | 5/2000 | Kelley et al. | 223/85 |
| 6,131,733 | A | * | 10/2000 | Ergle et al. | 206/315.1 |
| 6,256,840 | B1 | * | 7/2001 | Elliott | 24/3.11 |
| 6,363,244 | B1 | * | 3/2002 | McGhee | 379/450 |
| 6,427,293 | B1 | * | 8/2002 | Bowes, Jr. | 24/114.6 |

FOREIGN PATENT DOCUMENTS

WO WO 9738847 A1 * 10/1997

* cited by examiner

*Primary Examiner*—James R. Brittain
(74) *Attorney, Agent, or Firm*—Michael I Kroll

(57) ABSTRACT

A device for releasably attaching a towel to clothing of a user. The device includes a towel having an eyelet passing therethrough and a clasp for extending through the eyelet and releasably connecting with an article of clothing of a user. The towel may be removed from engagement with the clasp for cleaning when desired. The attachment of the device to the clothing of the user allows a towel to be readily available to the user for drying the user or cleaning an object.

1 Claim, 15 Drawing Sheets

TOWEL ATTACHMENT DEVICE

REFERENCE TO RELATED APPLICATIONS

This application is a continuation-in-part application of U.S. patent application Ser. No. 09/370,616 filed on Aug. 7, 1999 now U.S. Pat. No. 6,256,840.

BACKGROUND OF THE INVENTION

1. Field of the Invention

The present invention relates generally to sports accessories, and, more specifically, to a device for facilitating the ready use of a towel to insure that the towel can easily be employed in a usable position. The towel and towel clip on device are designed to be attached to a belt loop or waistband of the wearer. Towels and other absorbent materials are used by tradesmen, such as, painters, bartenders, waitresses, and roofers, to name a few. Towels and other absorbent materials are used by sporting event participants in a variety of services. Towels are used to wipe face and hands, clean soiled equipment such as golf balls, golf clubs, tennis racket handles, and tools.

Golf towels are carried in pockets, golf carts, or stored in hard to get compartments on a golf bag. The non-attachable towel most likely will end up lost or bulging out of a pocket. This method of carrying a towel can become an inconvenient task. Trying to locate a misplaced towel can take the sportsmen's concentration away from the sport.

In the case of golf, when the towel is strapped or tucked into a golf bag, it requires the golfer to return to the bag to use the towel. The present invention removes the burden by employing a towel having means for attaching the towel to an article of clothing such as a belt loop or waist band. This method of attachment ensures the towel is readily available, is also easily attached and released from engagement with the article of clothing. In addition the clip can be disengaged from the towel allowing the towel to be cleaned in a washing machine.

2. Description of the Prior Art

Numerous other clasp and towel devices are provided in the prior art. Typical of these in U.S. Pat. No. 5,671,515 issued to Evans on Sep. 30, 1997.

Another patent was issued to Roy on Oct. 15, 1996 as U.S. Pat. No. 5,564,166. Yet another U.S. Pat. No. 5,553,345 was issued to Bell on Sep. 10, 1996 and still yet another was issued on Jun. 7, 1994 to DeMarco as U.S. Pat. No. 5,318,292.

U.S. Pat. No. 5,671,515

Inventor: Michael D. Evans

Issued: Sep. 30, 1997

A clasp (10) for connecting two items includes two interconnecting members (11, 12). One member (11) utilizes a rivet (14) to engage one of the items, for example, a golf towel (23). That member (11) also has a receiver (24) formed therein which has a slot (25). The other member (12) has a tab (28) with a flexible button (30) extending upwardly therefrom. The tab (28) is received in the slot (25) until the button (30) snaps up through an aperture (21) in the cover (18) of the receiver (24). The members (11, 12) are thus attached to each other but the attachment can be disengaged merely by depressing the button (30) and sliding the tab (28) out of the slot (25). The other end of the member (12) has a foldable flap (26) which can be formed into a loop (40) to engage another item, for example, a portion (39) of a golf bag.

U.S. Pat. No. 5,564,166

Inventor: Armand E. Roy

Issued: Oct. 15, 1996

A badge clip secures a badge to be worn or carried by a person. The badge clip includes a fixed leg having a first end portion and an opposite second end portion with a curved barrel formation, and a movable leg having a first end portion with a curled barrel formation, and a movable leg having a first end portion which is reversely bent from the first end portion of the fixed leg, and an opposite second end portion which is engageable with the curled barrel formation of the fixed leg. The movable leg is pivotally movable between an open position and a closed position, the movable leg being biased to its closed position. The arrangement is such that the curled barrel formation of the fixed leg is capable of receiving a badge having an opening formed therein for securing the badge to the badge clip. The curled barrel formation is received through the opening of the badge when the movable leg is in its open position. The badge is secured to the badge clip when the movable leg resiliently returns to its closed position.

U.S. Pat. No. 5,553,345

Inventor: Steven Bell

Issued: Sep. 10, 1996

A clip-on towel is disclosed for use in sports and other activities where a readily accessible towel is advantageous. A first embodiment of the clip-on towel includes a clip portion that fits through an aperture in a towel portion and is adapted to engage the waistband of a user. The clip portion is attached to the towel by way of a restricted aperture thus eliminating the need for employing fasteners to attach the clip to the towel. A second embodiment includes a clip that is sewn to the towel and features a break away finger portion. If excessive force is applied to the clip, the towel breaks away from the user. The clip can be reassembled after breaking away inasmuch as it is designed to non-destructively separate.

U.S. Pat. No. 5,318,292

Inventor: Nicholas A DeMarco

Issued: Jun. 7, 1994

A springingly urged clasp is especially useful with a small towel such as the type used in golfing service and is a palm sized clasp which is both easily manually engageable and easily manually manipulable. The clamp, and its affixed towel, can be affixed to the golf bag, or any portion of the clothing to yield maximum easy utilization of the towel. In one embodiment, a golf towels reinforcing ring is fed into a slot on one side of the clamp of the present invention and onto a post to ensure secure, but interchangeable engagement.

While these golfing accessories may be suitable for the purposes for which they were designed, they would not be as suitable for the purposes of the present invention, as hereinafter described.

SUMMARY OF THE PRESENT INVENTION

The present invention discloses a towel including a clasp for attaching the towel to an article of clothing. A flap is attached to the towel which forms a partial pocket-like enclosure on the towel in which items can be cleaned. An alligator clip-like element is also shown for attaching the present invention to the article of clothing.

A primary object of the present invention is to provide a towel attachment device which can be carried around by tradesmen in the performance of their tasks as well as sportsmen.

Another object of the present invention is to provide a towel attachment device which can be attached to an article of clothing.

Yet another object of the present invention is to provide a towel attachment device having a clasp having means for attaching a towel with an eyelet and having means for selectively attaching said clasp and towel to an article of clothing.

A still further object of the present invention is to provide a towel attachment device having a clasp having means for attaching a towel with an eyelet and having means for selectively attaching said clasp and towel to an article of clothing with said towel being made of material used for silkscreening for the purpose of advertising.

Additional objects of the present invention will appear as the description proceeds.

The present invention overcomes the shortcomings of the prior art by providing a device for facilitating the ready use of a towel to insure that the towel can easily be employed in a usable position. The towel and towel clip on device are designed to be attached to a belt loop or waistband of the wearer. In addition the towel can be machine washed having means for disengaging the clip from the towel.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
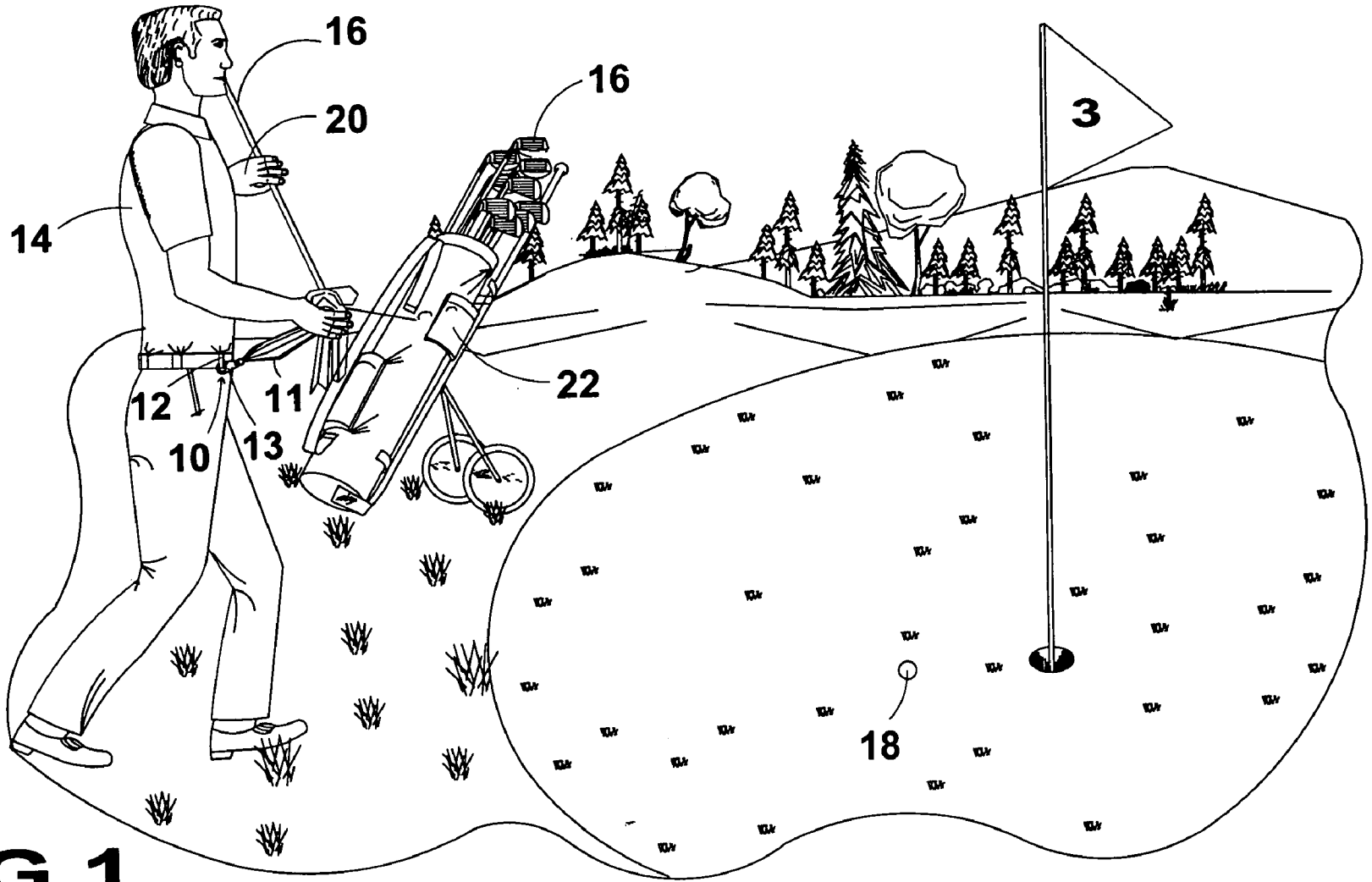
FIG. 1 is an illustrative view of one of the use of the towel attachment device of the present invention. Shown is a golfer having the clasp towel attached to an article of clothing within easy reach whereby a golfer can clean golf equipment, such as clubs and balls, as well as, hands without having to return to the golf cart. The clasped towel is small enough and light enough so as not to interfere with the players game.

With regard to reference numerals used, the following numbering is used throughout the drawings.

10 towel attachment device of the present invention
11 towel
12 clothing article
13 clasp
14 golfer
16 golf club
18 golf ball
20 hand
22 golf cart
24 eyelet
26 looped wire member
28 recess
30 latching arm
32 alligator-like clip
34 waist band
36 apperture
38 flap
39 partial enclosure
40 attachment on one side
42 club cloth
44 towel body
46 two edges
48 first clamp member
50 second clamp member
51 first side of S-clip
52 spring
53 second side of S-Clip
54 S-Clip
55 hollow ball
56 retractable wire clip
57 wire housing case
58 wire
59 clip
60 single sided attachment hook
61 eyelet
62 first moveable button
63 first hook
64 first latch
65 main cylinder body
66 carabiner
67 c-shaped member
68 latch
70 pivot point
71 main cylinder body
72 double sided attachment hook
73 first piece of material
74 closed U-Shaped ring
75 harness
76 second piece of material
78 seal line
79 adhesive layer
80 first fastener
81 recess extending through the hollow ball
82 second hook
83 second latch
84 second moveable button
85 second fastener

DETAILED DESCRIPTION OF THE PREFERRED EMBODIMENT

In order that the invention may be more fully understood, it will now be described, by way of example, with reference to the accompanying drawings in which FIGS. 1 through 19 illustrate the towel attachment device of the present invention indicated generally by the reference numerals.

Turning to FIG. 1, shown therein is an illustrative view of one example of the use of the towel attachment device of the present invention 10. Shown is a golfer 14 having the towel attachment device 10 including a towel 11 attached to an article of clothing 12. The towel attachment device 10 is releasably secured in easy reach whereby a golfer 14 can clean golf equipment, such as clubs 16 and balls 18, as well as, hands 20 without having to return to the golf cart 22. The towel attachment device 10 is small enough and light enough so as not to interfere with the players game.

Figure 2:
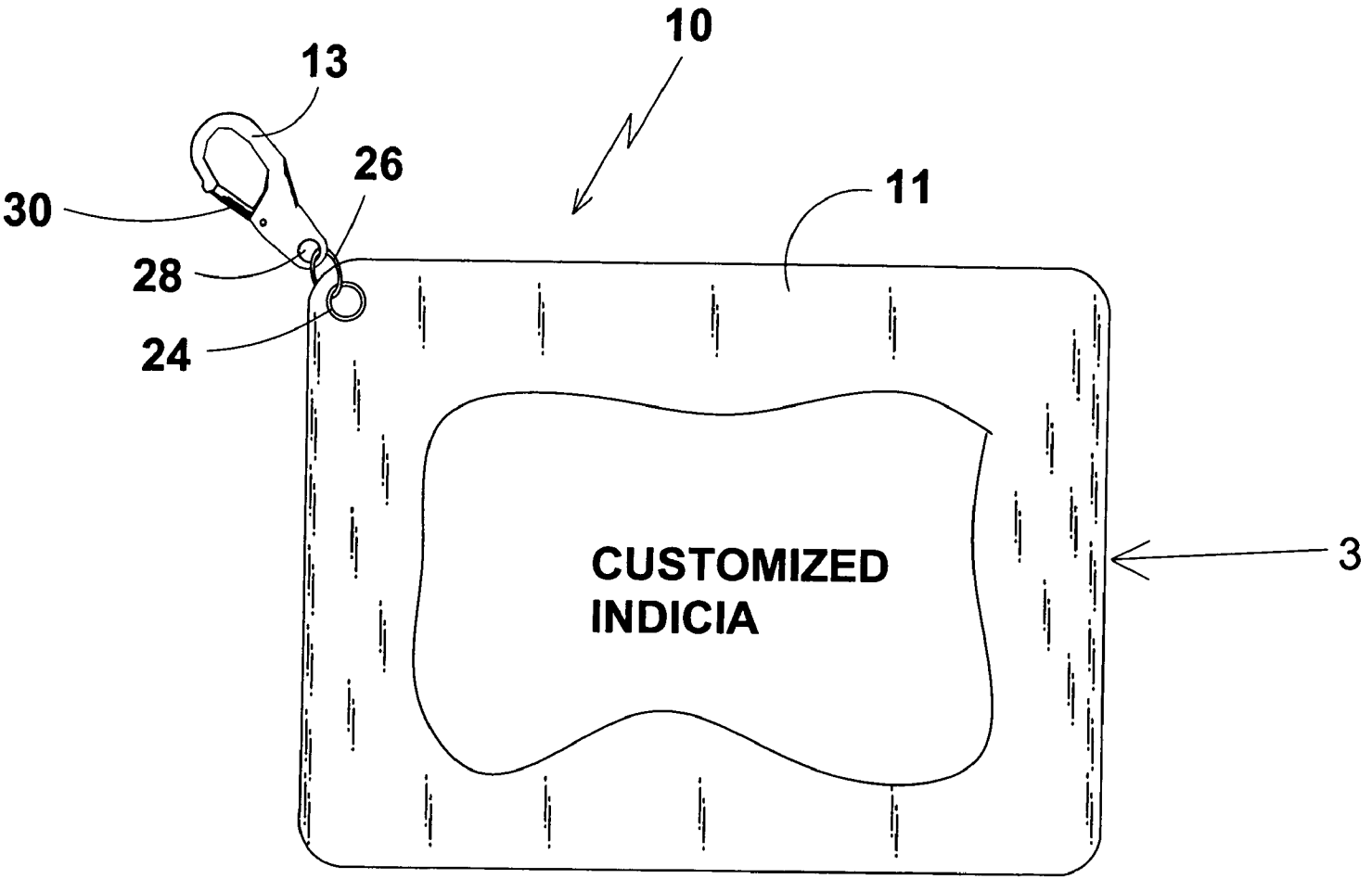
FIG. 2 is a front view of the towel attachment device of the present invention. Shown is a towel having an eyelet therein providing means for attaching a looped wire member thereto. Also shown is a clasp having means for attaching the looped wire member and towel thereto. Further the clasp includes a means for attaching the clasp, wire member and towel to an article of clothing.

Turning to FIG. 2, shown therein is a front view of the towel attachment device of the present invention 10. The towel attachment device 10 includes the towel 11 having an eyelet 24 therein allowing attachment of a looped wire member 26 thereto. Also shown is a hook-like clasp 13 including a recess for attaching the looped wire member 26 and towel 11 thereto. Further, the clasp 13 includes a device 30 for latching the clasp 13, wire member 26 and towel 11 to an article of clothing.

Figure 3:
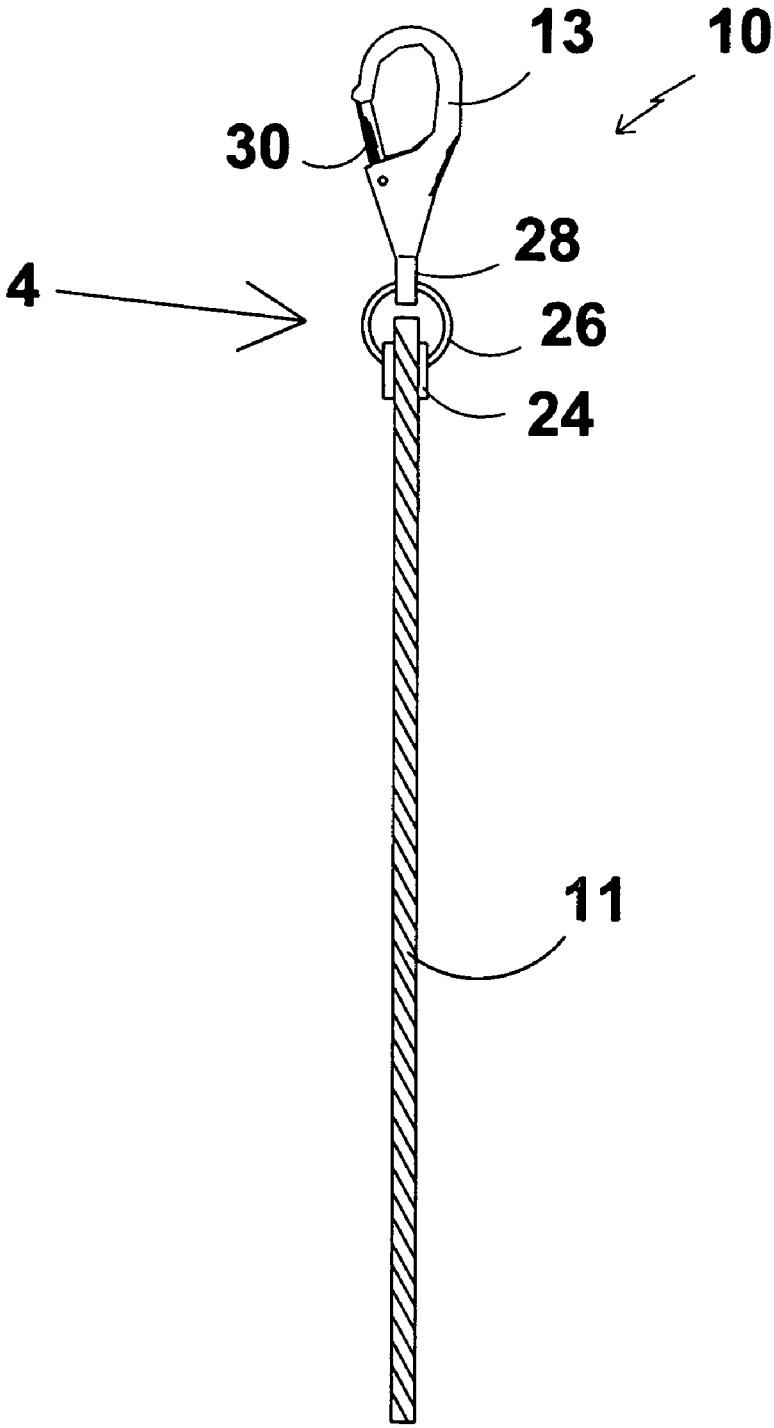
FIG. 3 is a side cross-sectional view of the towel device of the present invention, taken at the arrow labeled 3 in FIG. 2. Shown is a towel having an eyelet therein providing means for attaching a looped wire member thereto. Also shown is a clasp having means for attaching the looped wire member and towel thereto. Further the clasp includes means for attaching the clasp, wire member and towel to an article of clothing.

Turning to FIG. 3, shown therein is a side cross-sectional view of the towel attachment device of the present invention 10 taken in the direction of the arrow labeled with the numeral 3 of FIG. 2. Shown is the towel 11 having an eyelet 24 therein for attaching the looped wire member 26 thereto. Also shown is a clasp 13 including a recess 28 for connecting the looped wire member 26 and towel 11 to the clasp 13.

Further the clasp 13 includes a latching arm for releasably securing the clasp 13, wire member 26, and towel 11 to an article of clothing 12.

Figure 4:
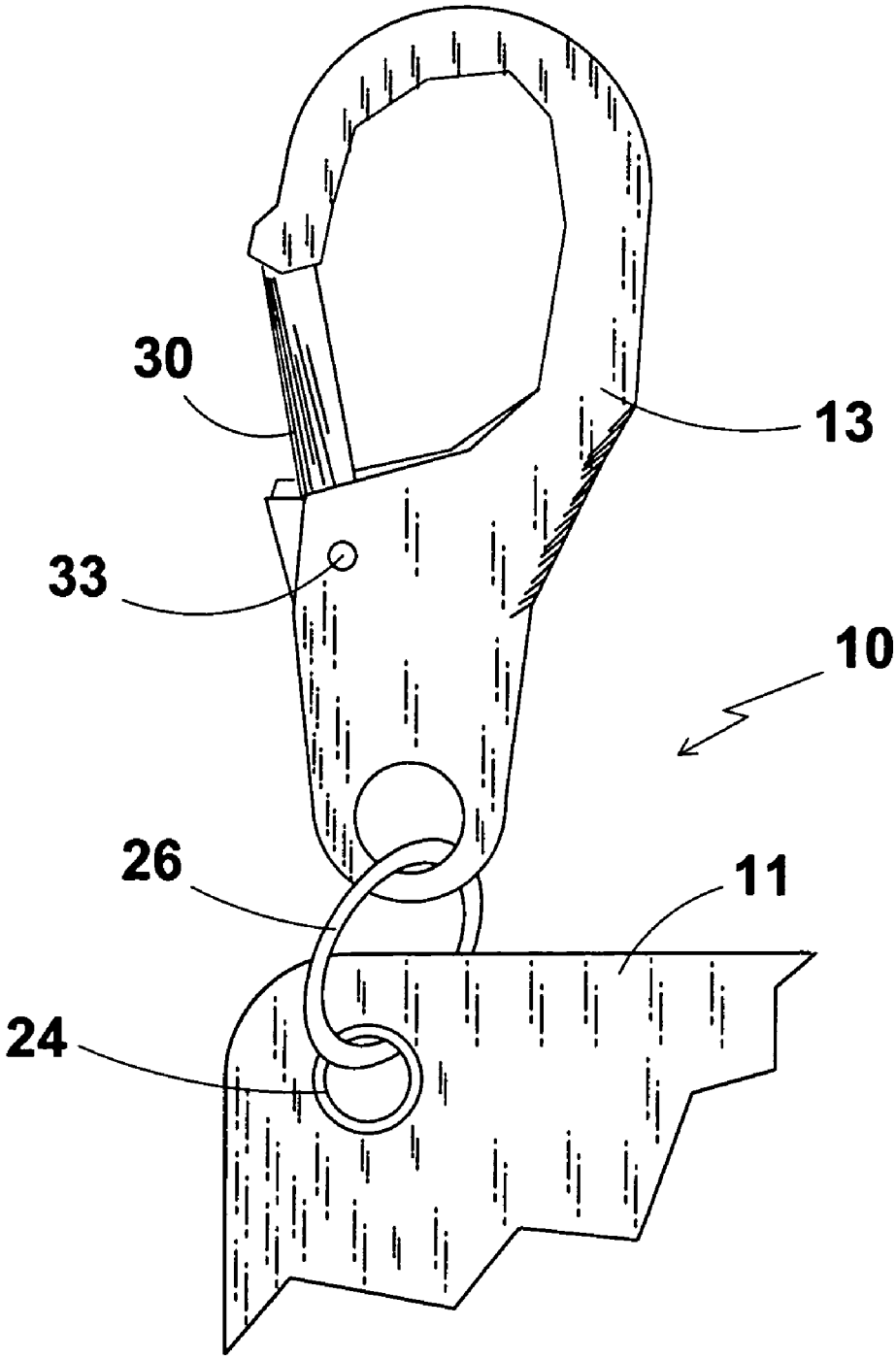
FIG. 4 is an enlarged view of the clasp of the towel attachment device of the present invention, taken in the direction of the arrow labeled 4 in FIG. 3. Shown is a clasp including means for selective attachment to an article of clothing. A wire member providing means for attaching one or more towels to the clasp. Also shown is a portion of a towel having an eyelet attached therein providing means for attachment to the looped wire member.

Turning to FIG. 4, shown therein is an enlarged sectional view of the clasp 13 of the towel attachment device 10 of the present invention. This view is taken in the direction of the arrow labeled with the numeral 4 in FIG. 3. Shown is the clasp 13 having the latching arm 30 for releasably securing the towel device 10 to an article of clothing 12. The latching arm 30 is pivotally connected to the clasp 13 at pivot point 33. The latching arm 30 may be secured in the locked position by a friction lock or may be spring loaded. The wire member 26 provides means for attaching one or more towels 11 to the clasp 13. Also shown is a portion of a towel 11 having an eyelet 24 for attaching the towel 11 to the looped wire member 26.

Figure 5:
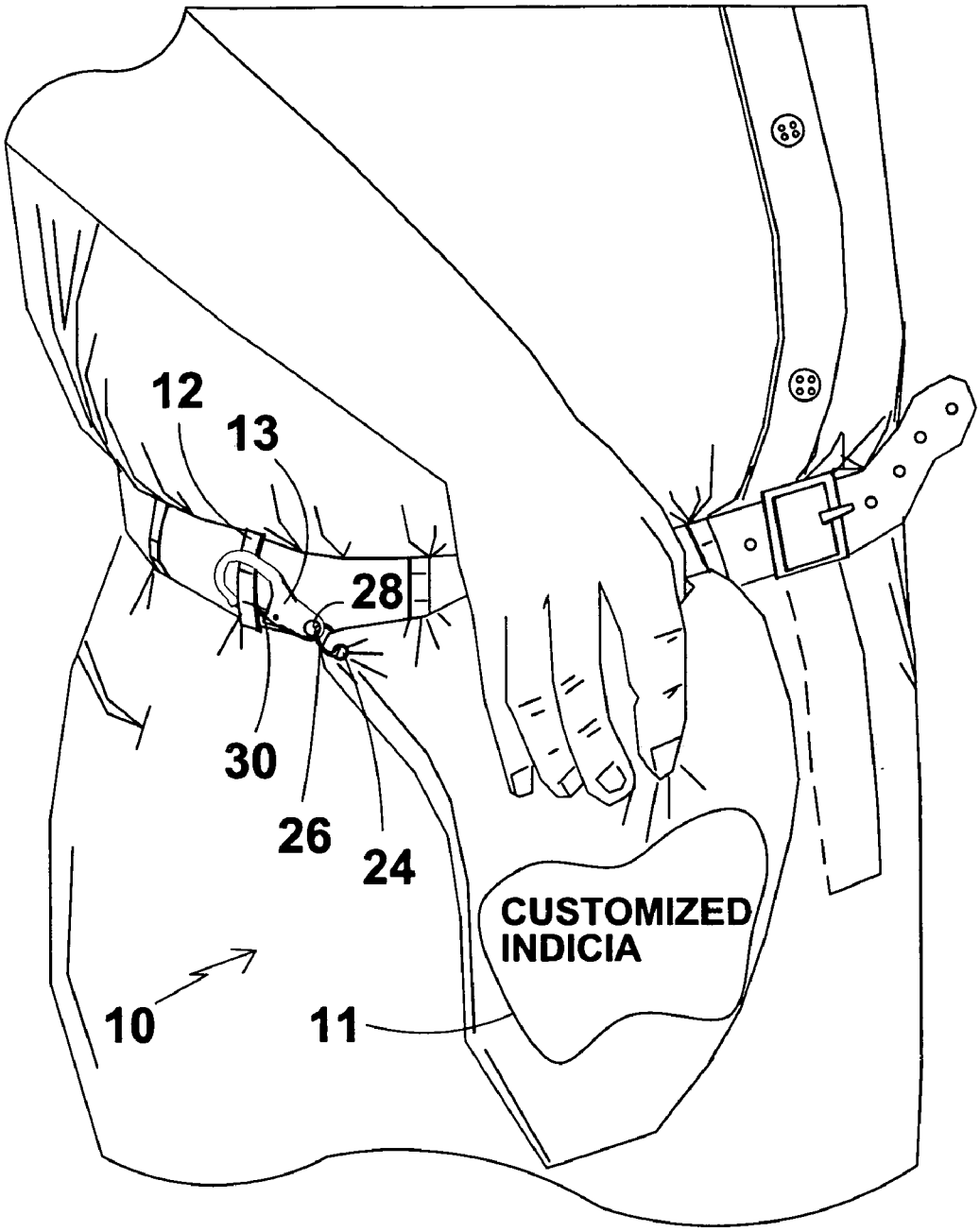
FIG. 5 is a perspective view of the towel attachment device of the present invention attached to an article of clothing such as a belt loop. The towel includes an eyelet therein providing means for attaching a looped wire member thereto. Also shown is a clasp including means for attaching the looped wire member and towel thereto. Further, the clasp having means for selectively attaching the clasp, wire member and towel to an article of clothing.

Turning to FIG. 5, shown therein is a perspective view of the towel attachment device 10 of the present invention attached to an article of clothing 12. The towel attachment device 10 is selectively attached to a belt loop 12. The towel 11 includes the eyelet 24 therein for attaching the looped wire member 26 thereto. The clasp 13 includes a recess 28 for securing the looped wire member 26 and towel 11 to the clasp 13. Further, the clasp 13 includes the latching arm 30 for selectively securing the clasp 13, wire member 26, and towel 11 to an article of clothing 12.

Figure 6:
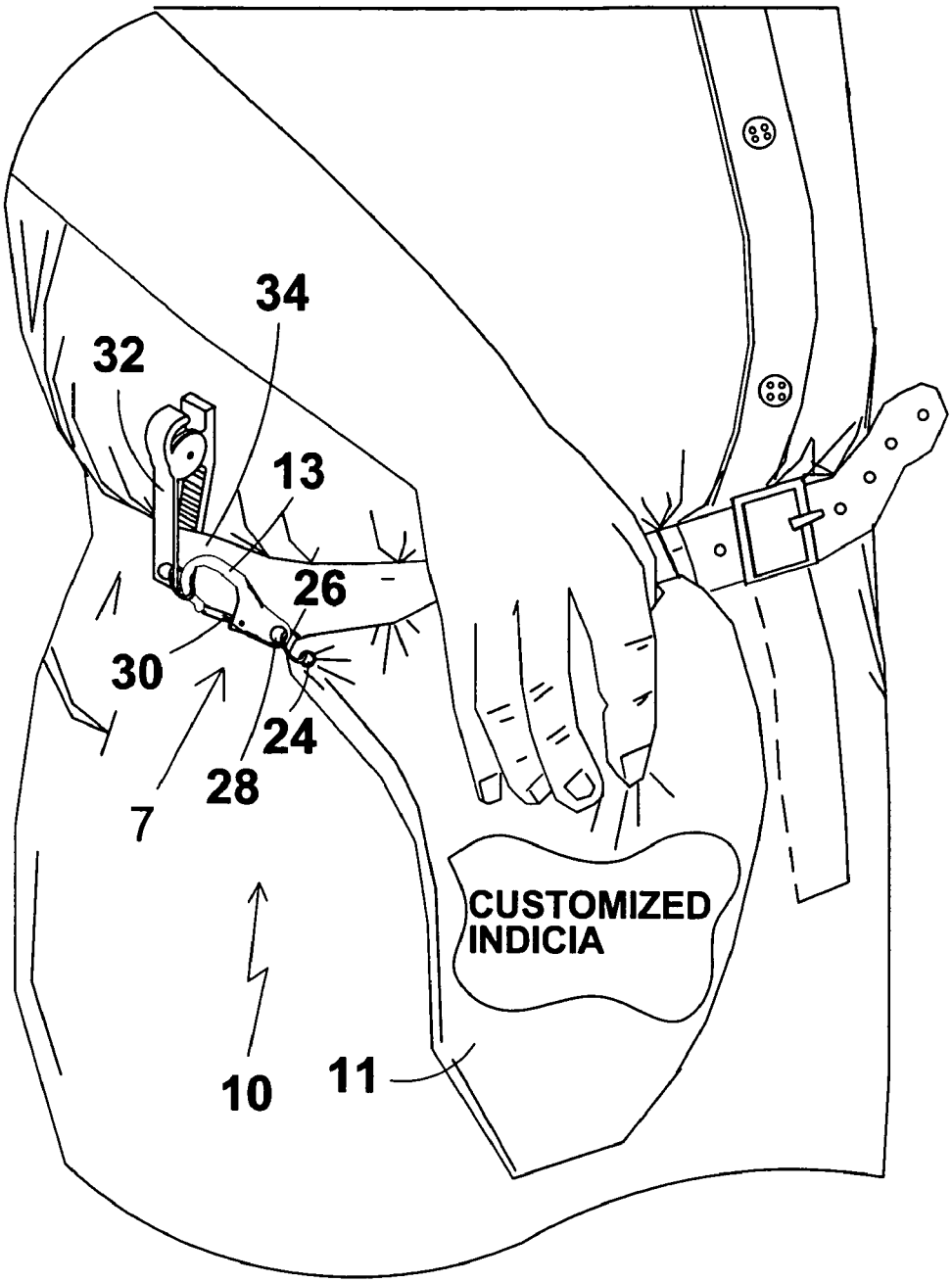
FIG. 6 is a perspective view of the towel attachment device of the present invention attached to an article of clothing such as a waistband. The towel includes an eyelet therein providing means for attaching a looped wire member thereto. Also shown is a clasp having means for attaching the looped wire member and towel thereto. Further, the clasp includes means for selectively attaching the clasp, wire member and towel to an alligator-like clip having means for selective attachment to an article of clothing, such as a waistband.

Turning to FIG. 6, shown therein is a perspective view of the towel attachment device 10 of the present invention attached to an article of clothing 12. The towel attachment device 10 is selectively attached to a waistband 34 of the user. The towel 11 includes an eyelet 24 therein through which the looped wire member 26 is secured. The clasp 13 includes the recess 28 through which the looped wire member 26 and towel 11 are connected to the clasp 13. Further, the clasp 13 includes a latching arm 30 for releasably securing the clasp 13, wire member 26 and towel 11 to an alligator-like clip 32 for selectively attaching the towel attachment device to an article of clothing, such as the waistband 34.

Figure 7:
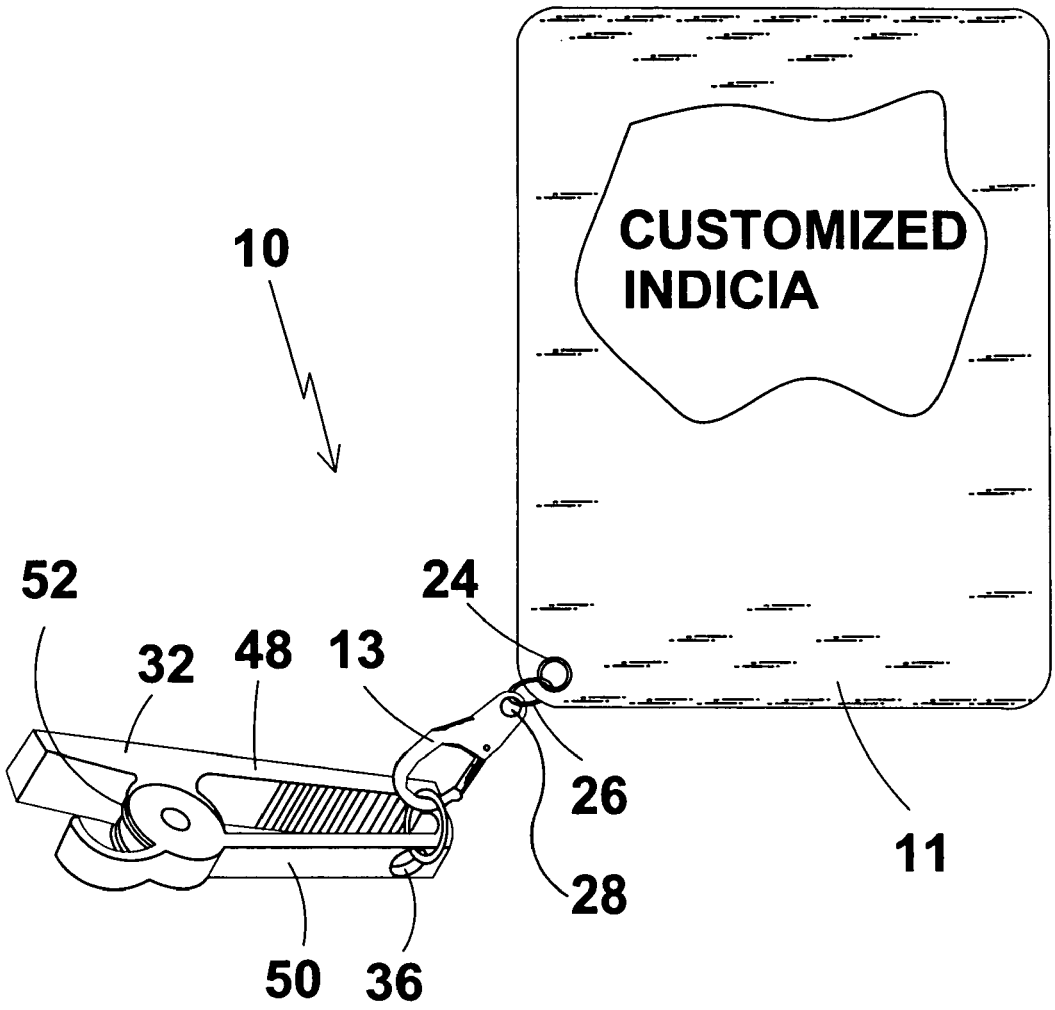
FIG. 7 is a front view of the towel attachment device of the present invention including an alligator-like clip having means for attaching the clip to an article of clothing. The towel attachment device also includes means for attaching a clasp to the alligator clip. The clasp includes means for attaching a looped wire member providing means for attaching one or more towels to the clasp. Also shown is a the towel having an eyelet attached therein providing means for attachment to the looped wire member.

Turning to FIG. 7, shown therein is a front view of the towel attachment device 10 of the present invention. The towel attachment device 10 includes an alligator-like clamp or clip 32 for attaching the towel attachment device to an article of clothing 34. The alligator-like clip 32 includes first and second opposing clamping members 48 and 50 which are biased to a clamping position by spring 52. An aperture extends through the clip 32 for receiving and selectively attaching the clasp 13 to the alligator clip 32. The clasp 13 includes a recess 28 for receiving the looped wire member 26. The wire member 26 allows for attachment one or more towels 11 to the clasp 13. Also shown is the towel 11 having an eyelet 24 attached therein for selective connection to the looped wire member 26.

Figure 8:
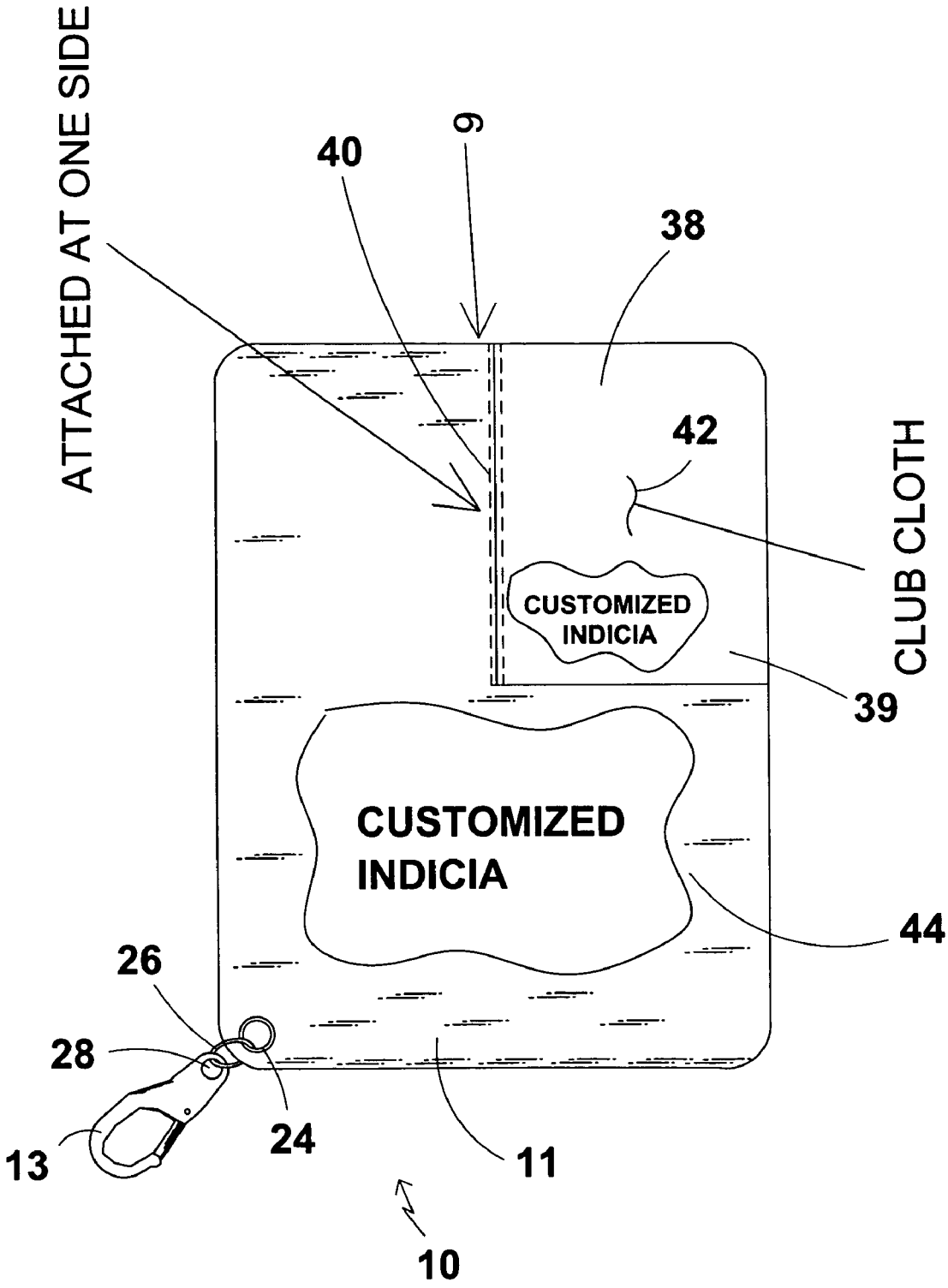
FIG. 8 is a front view of the towel attachment device of the present invention including a clasp having means for attaching a looped wire member thereto. The towel includes an eyelet providing means for attaching the towel to the looped wire member and a flap secured on one edge to the body of the towel forming an enclosed towel portion whereby the user can clean wet and muddy items within the enclosure formed by the flap without getting mud on themselves.

Turning to FIG. 8, shown therein is a front view of the towel attachment device 10 of the present invention. Shown is a clasp 13 having a recess 28 for attaching the looped wire member 26 thereto. Also shown is a towel 11 having an eyelet 24 for attaching the looped wire member 26 to the towel 11. Further, the towel 11 includes the flap 38 forming a club cloth 42. The club cloth 42 is secured on one edge 40 to the main body 44 of the towel 11 to form a partially enclosed towel portion 39 whereby the user can clean wet and muddy items within the partial enclosure 39 formed by the flap 38 without getting mud on themselves.

Figure 9:
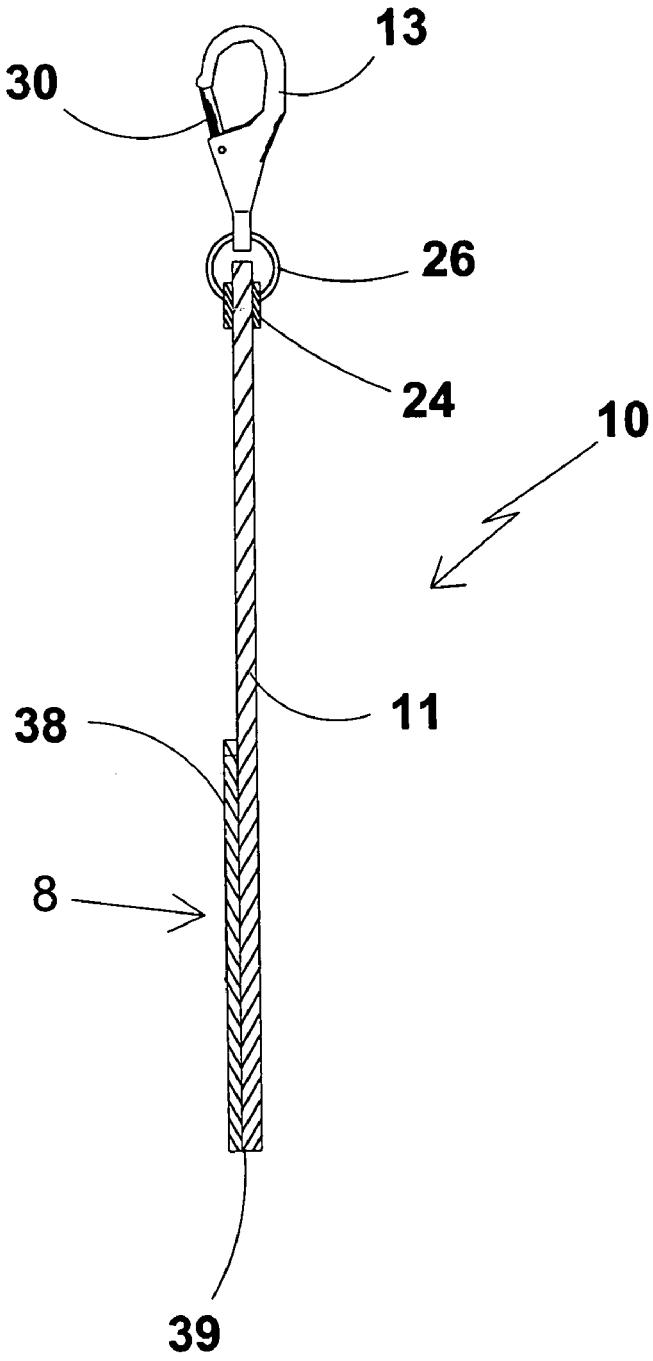
FIG. 9 is a side cross-sectional view of the towel attachment device of the present invention, taken in the direction of the arrow labeled with the numeral 9 in FIG. 8. Shown is a towel having a flap and an eyelet. A looped wire member provides means for detaching the towel from the clasp whereby the towel can be replaced or washed. The wire member includes means for attaching one or more towels having eyelets thereto and having means for selectively attaching the clasped towel to an article of clothing.

Turning to FIG. 9, shown therein is a side cross-sectional view of the towel attachment device 10 of the present invention taken in the direction of the arrow labeled 9 in FIG. 8. Shown is the towel 11 having the flap 38 and eyelet 24. The looped wire member 26 is releasably connected between the towel 11 and the clasp 13 whereby the towel 11 can be released from engagement with the clasp 13 for replacement or washing. The wire member 26 allows for attachment of one or more towels having eyelets 24 to the clasp 13 which includes the recess 28 for selectively attaching the clasped towel 10 to an article of clothing 12 (not shown). The partial enclosure 39 is also shown in this figure and has been previously disclosed.

Figure 10:
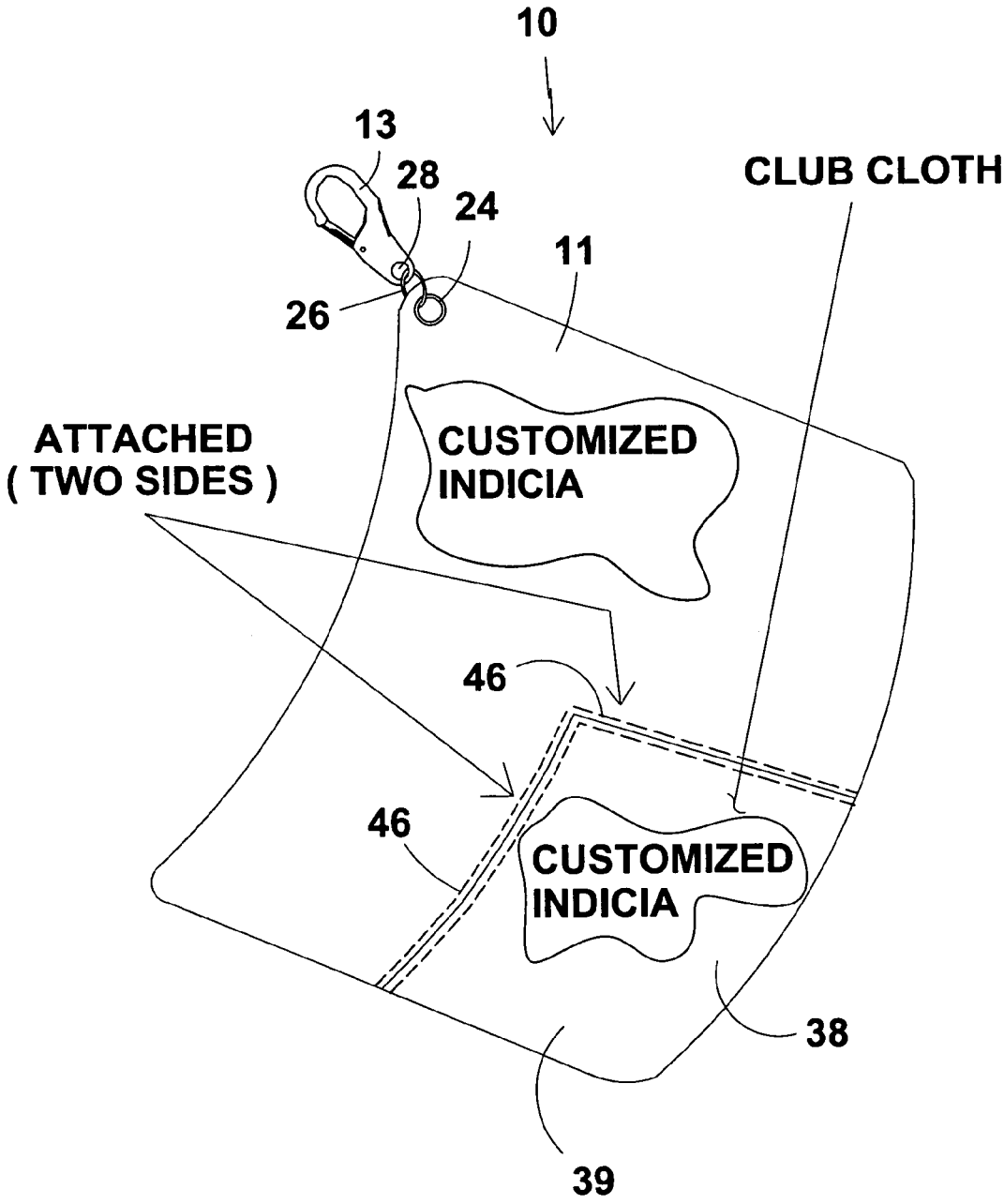
FIG. 10 is a front view of the towel attachment device of the present invention. Shown is a clasp having means for attaching a looped wire member thereto. Also shown is a towel having an eyelet providing means for attaching the towel to the looped wire member. Further, the towel has a flap secured on two edges to the body of the towel forming an enclosed towel portion whereby the user can clean wet and muddy items within the enclosure formed by the flap without getting mud on themselves.

Turning to FIG. 10, shown therein is a front view of the towel attachment device of the present invention. Shown is the clasp 13 having a recess 28 for connection with the looped wire member 26. Also shown is the towel 11 having the eyelet 24 for receiving the looped wire member 26. Further the towel 11 has a flap 38 secured along two edges 46 to the body of the towel 11 to form a partially enclosed towel portion 39 whereby the user can clean wet and muddy items within the enclosure 39 formed by the flap 38 without getting mud on themselves.

Figure 11:
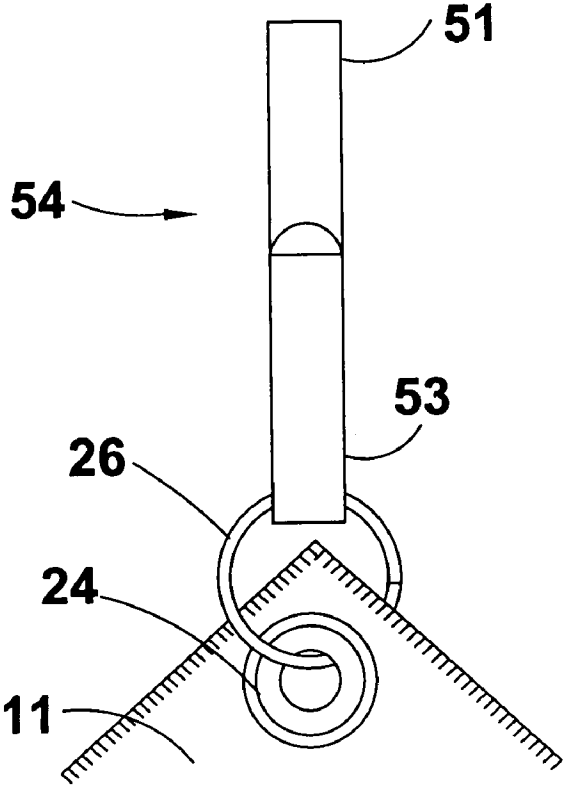
FIG. 11 is a front view of an S-clip and the means by which it is attached to a towel for use with the towel attachment device of the present invention.

FIG. 11 is front view of an S-Clip attachment mechanism 54 for the towel attachment device. The S-Clip 54 includes a first side 51 and a second side 53. Further shown is the looped wire member 26. Both first side 51 and second side 53 can be clipped to objects. Preferably the first side 51 is clipped to an article of clothing of the user and the second side 53. Second side 53 is clipped to the looped wire member 26. The looped wire member 26 is also received through the eyelet 24 of the towel 11. The S-Clip 54 is made of a rigid material capable of holding its shape thereby preventing deformation of the S-Clip 54.

Figure 12:
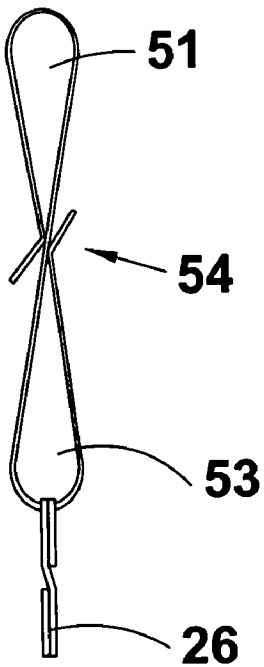
FIG. 12 is a side view of the S-Clip of the towel attachment device of the present invention.

FIG. 12 is a side view of the S-Clip 54 attachment mechanism for the towel attachment device 10. As can be seen from this view, the second side 53 receives the looped wire member 26 thereby releasbly attaching the looped wire member 26 to the second side 53 of the S-Clip 54. The looped wire member 26 is also received through the eyelet 24 of the towel 11 thereby attaching the S-Clip 54 to the towel 11. In FIG. 12 the towel 11 is not shown attached to the S-Clip 54 via the looped wire member 26.

Figure 13:
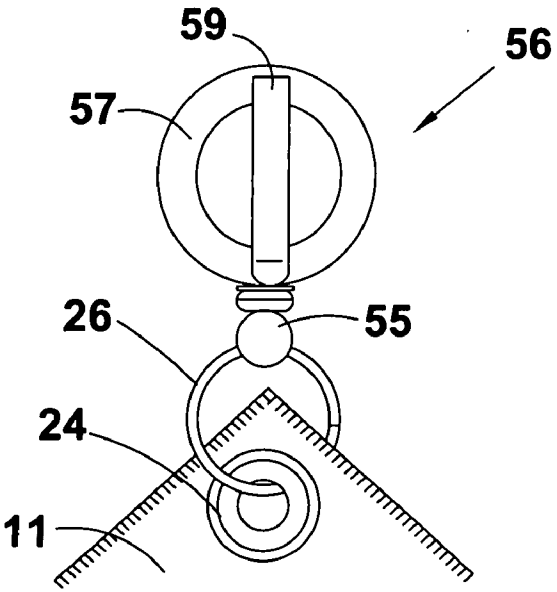
FIG. 13 a front view of a retractable wire clip of the towel attachment device of the present invention.

FIG. 13 is a front view of a retractable wire clip attachment mechanism 56 for the towel attachment device 10. The retractable wire clip 56 includes a wire housing case 57 and a clip 59. The clip 59 is attached to the wire housing case 57. The clip 59 is used to attach the retractable wire clip 56 to the clothing of a person. A hollow ball 55 is positioned at the bottom of the wire housing case 57. The hollow ball 55 includes a recess extending therethrough for receiving the looped wire member 26. The looped wire member 26 allows for attachment of one or more towels to the retractable wire clip 56. The looped wire member 26 is also received by the eyelet 24 within the towel 11 thereby connecting the towel 11 to the retractable wire clip 56. Positioned within the wire housing case 57 of the retractable wire clip 56 is a wire 58 allowing the towel to be extended to a distance from the retractable wire clip 56.

Figure 14:
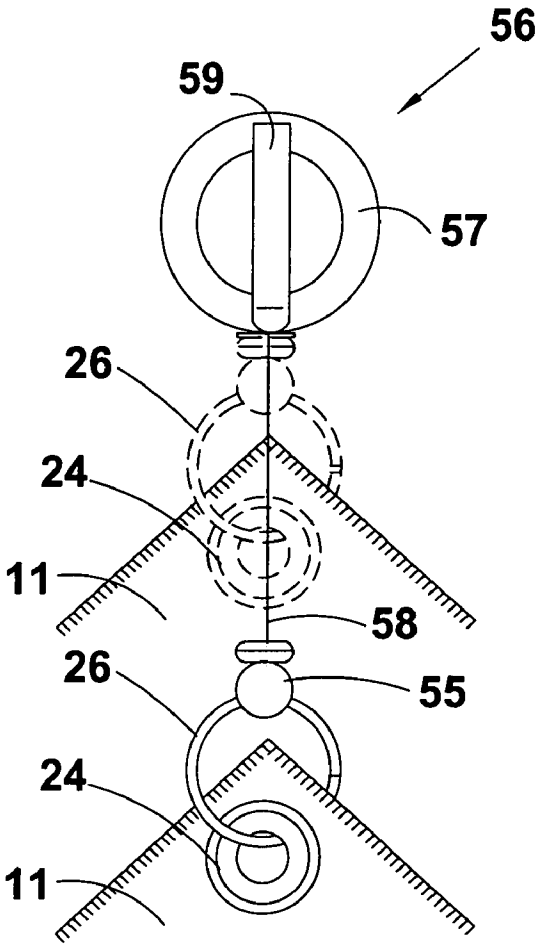
FIG. 14 is a front view of the retractable wire clip of the towel attachment device of the present invention illustrating the wire clip both secured and released from engagement with the towel.

FIG. 14 is a front view of the retractable wire clip attachment mechanism 56 for the towel attachment device 10. FIG. 14 shows the retractable wire clip 56 with the wire 58 in an elongated position thereby separating the towel 11 and the clip 56 by a distance equal to the length of extension of the wire. The clip 59 attaches the retractable wire clip 56 to the clothing of a person. The hollow ball 55 is positioned at the bottom of the wire housing case 57 and includes the recess for receiving the looped wire member 26. The looped wire member 26 attaches one or more towels to the retractable wire clip 56. Further shown is the eyelet 24 provided within the towel 11. The looped wire member 26 is received through the eyelet 24 within the towel 11 thereby connecting the towel 11 to the retractable wire clip 56.

Figure 15:
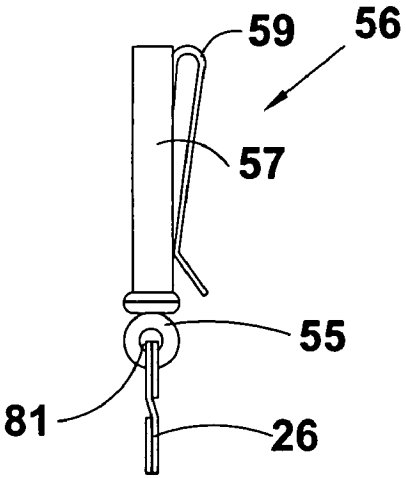
FIG. 15 is a side view of the retractable wire clip of the towel attachment device of the present invention.

FIG. 15 is a side view of the retractable wire clip attachment mechanism 56 for the towel attachment device 10. As can be seen from this view the clip 59 is attached to and extends from the wire housing case 57. The clip 59 is used to attach the retractable wire clip to the clothing of a person. Positioned at the bottom of the wire housing case 57 is the hollow ball 55. The hollow ball 55 includes a recess 81 for receiving the looped wire member 26. The looped wire member 26 provides for attachment of one or more towels to the retractable wire clip 56.

Figure 16:
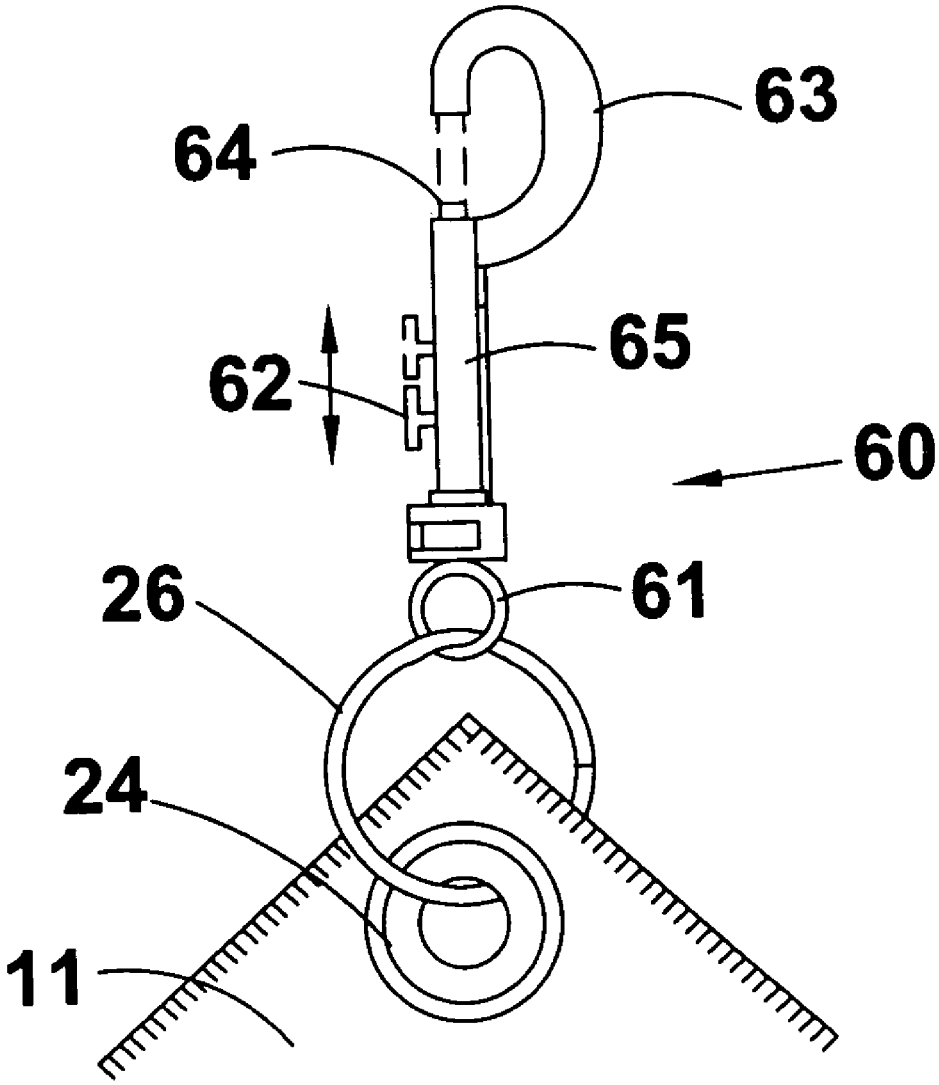
FIG. 16 is a front view of a single-sided attachment hook of the towel attachment device of the present invention.

FIG. 16 is a front view of a single sided attachment hook 60 for the towel attachment device 10. The single sided attachment hook 60 includes a hook 63, a latch 64, a main body cylinder 65, a moveable button 62, and an eyelet 61. The hook 63 and latch 64 are positioned on one side of the main body cylinder 65. The hook 63 and latch 64 are used to attach the single sided attachment hook 60 to the clothes of a user. The eyelet 61 is positioned on the main body cylinder 65 on the side opposite of hook 63 and latch 64 for receiving the looped wire member 26 therethrough. Further positioned on the main body cylinder 65 is moveable button 62. The moveable button 62 controls the movement of the latch 64. The latch 64 is moveable between a first open position for releasing or securing the towel attachment device 10 to clothing of a user and a second closed position for maintaining the towel attachment device 10 secured to the article of clothing of the user. The looped wire member 26 is further attached to the eyelet 24 that is provided within the towel 11 for securing the towel 11 to the attachment hook 60.

Figure 17:
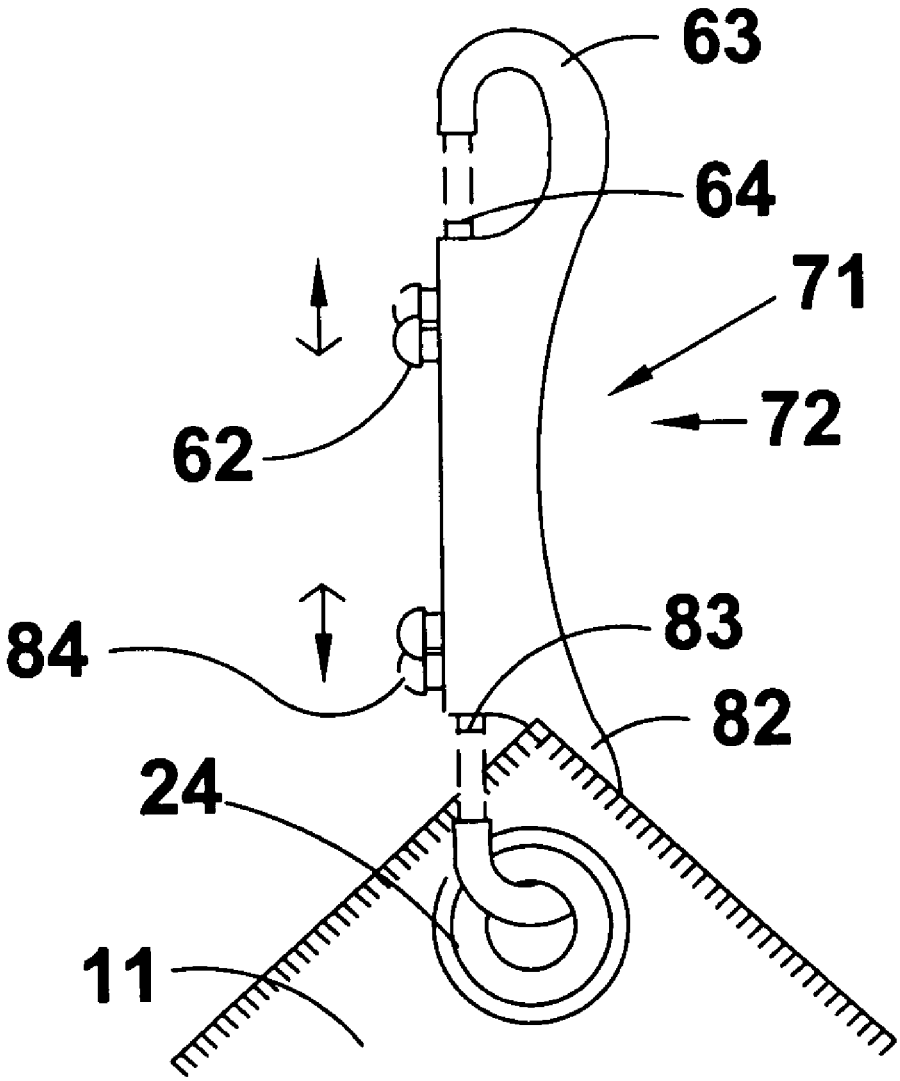
FIG. 17 is a front view of a double-sided attachment hook of the towel attachment device of the present invention.

FIG. 17 is a front view of a double sided attachment hook mechanism 72 for the towel attachment device 10. The double sided attachment hook 72 is composed of a main body cylinder 71, first and second hooks 63 and 82, first and second latches 64 and 83, and first and second moveable buttons 62 and 84. First hook 63 and first latch 64 are positioned on one end of the main body cylinder 71. The second hook 82 and second latch 83 are positioned on the opposite side of the main body cylinder 71. The first moveable button 62 extends from the main body cylinder 71 and controls the movement of the first latch 64 between a first open position and a second closed position. The second moveable button 84 extends from the main body cylinder 71 and controls the second latch 83 between a first open position and a second closed position. The first hook 63 and first latch 64 are used to attach the double hook clip 72 to the user. The second hook 82 and second latch 83 are used to attach the towel 11 to the double sided attachment hook 72 via the eyelet 24.

Figure 18:
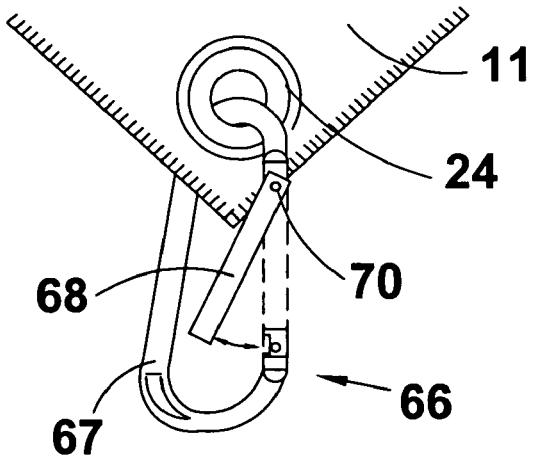
FIG. 18 is a front view of a carabiner of the towel attachment device illustrating the pivoting of the locking arm.

FIG. 18 is a front view of a carabiner attachment mechanism for use with the towel attachment device 10. The carabiner 66 includes a C-shaped member 67, a latch 68, and a pivot point 70. The latch 68 is pivotally connected to the C-shaped member 67 at pivot point 70. The latch is pivotable between a first open position and a second closed position. When the latch is in the second closed position, the latch 68 and C-Shaped member 67 form a complete ring capable of being secured to clothing. When the latch 68 is in the first opened position, the carabiner 66 can be secured to the towel 11 by placing the carabiner 66 through the eyelet 24 provided within the towel 11. Further, the carabiner 66 can attach to the clothes of the user when the latch 68 is in the first open position.

Figure 19:
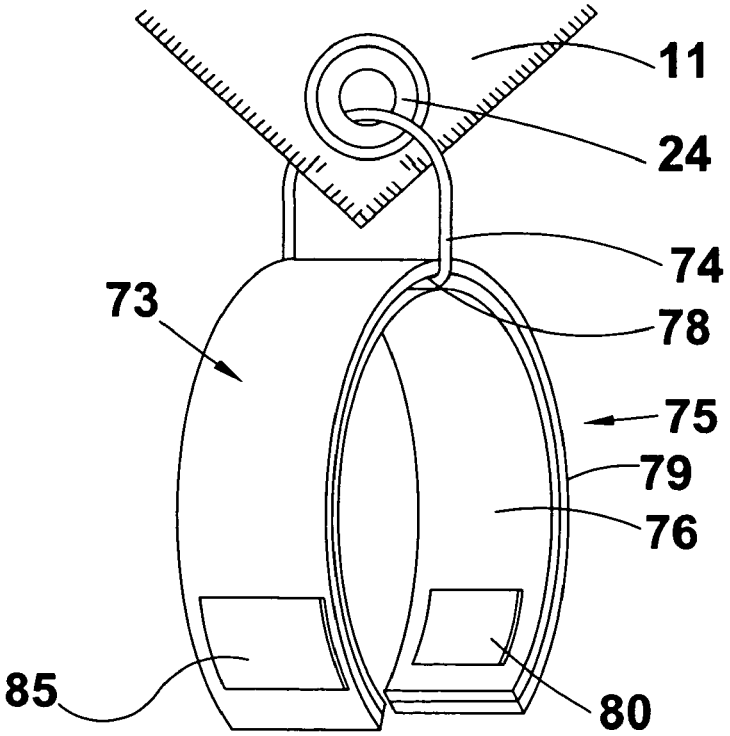
FIG. 19 is a front view of a material attachment clip with a fastener of the towel device of the present invention.

FIG. 19 is a front view of the material attachment clip 75 for use with the towel attachment device 10. The material attachment clip 75 includes a first piece 73 and a second piece 76. The material attachment clip 75 further includes a fastening mechanism 80. The material attachment clip 75 is attached to the towel 11 by a closed U shaped ring 74. The closed U-shaped ring 74 extends through the eyelet 24 provided within the towel 11. The first piece of material 73 is positioned through the closed U-shaped ring 74. The second piece of material 76 is of substantially similar dimensions to the first piece of material 73 and is positioned against the first piece of material 73. An adhesive layer 79 is positioned on the top side of the second piece of material 76 thereby securing the second piece of material 76 to the first piece of material 73. Further the U-shaped ring 74 is preferably positioned between the first piece of material 73 and second piece of material 76 thereby securing the closed U-shaped ring 74 therebetween. Positioned at one end of the second piece of material is a first fastener 80. Positioned at an opposing end of the first piece of material 73 is a second fastener 85. When the first and second fasteners 80 and 85 are fastened together the material attachment clip 75 is able to be releasably secured to the users clothing. The fasteners 80 can be at least one of hook and loop fasteners, a snap, a button, and a magnet.

The operation of the towel attachment device will now be described with reference to the figures and specifically FIGS. 11 through 19. The clips represented in the figures, e.g. the S-Clip 54, the retractable wire clip 56, the single sided attachment hook 60, the double sided attachment hook 72, the carabiner 66, and the material attachment clip 72 all operate in a substantially similar manner to releasably securing the towel 11 to an article of clothing worn by a user. Each clip attaches either directly to the towel 11 by extending through the eyelet provided therein or via a looped wire member 26. Furthermore, each clip includes a securing mechanism to releasably attach to an article of clothing worn by a user.

The S-Clip 54, the retractable wire clip 56, and the single sided attachment hook 60 are releasably attached to the towel 11 via the looped wire member 26. In each instance, the looped wire member 26 extends through the eyelet 24 of the towel 11. The S-Clip 54, the retractable wire clip 56, and single sided attachment hook 60 each include a recess extending through one end thereof for receiving the looped wire member 26. When the looped wire member 26 is connected to extend through both the eyelet 24 of the towel 11 and the recess, the respective clip is releasably secured to the towel 11.

The double sided attachment hook 75 and the carabiner 66 are constructed so as to connect with the towel 11 via a direct connection with the eyelet 24. The double sided attachment hook 75 and the carabiner 66 connect the towel to the clothing of a user without the use of the looped wire member 26.

The double sided attachment hook 75 includes the second hook 82, second latch 83 and the second moveable button 84 for releasably attaching itself to the towel 11. When the second moveable button is operated to move the second latch 83 into the open position, the second hook 82 can be extended through the eyelet 24 provided within the towel 11. When the second movable button is operated to move the second latch 83 into the second closed position, the second hook 82 releasably attaches the double sided attachment hook 75 to the towel 11. The carabiner 66 has a latch 68 that when moved into the second open position allows the C-shaped member 67 to be extended through the eyelet 24 provided within the towel 11. When the latch 68 is moved back into the closed position, the carabiner 66 is releasably attached to the towel 11. The material attachment clip 75 is connected to the towel 11 via a closed U-shaped ring whereby the U-shaped ring is extended through the eyelet 24 provided within the towel 11.

The S-Clip 54 and the retractable wire clip 56 connect to the clothing of the user via a clip, i.e. reference numerals 51 or 53 in FIG. 11 and reference numeral 59 in FIGS. 13, 14, and 15. The S-Clip 54 can be clipped to the clothing of a user via the use of the first side clip 51 or second side clip 53. Although either clip may be used to connect with either or both the towel and clothing of the user, it is preferred to connect the towel with one of the first and second clips while connecting the other of the first and second clips to the clothing of the user. The retractable wire clip releasably attaches itself to the users clothing via clip 59. The single sided attachment hook 60 and the double sided attachment hook 75 make use of a first hook 63 and first latch 64 mechanism controlled by a first moveable button 62. The first moveable button 62 operates the first latch 64 to move into a first open position whereby the first hook 63 is able to receive the clothing of a user, preferably a belt loop or a waistband. When the first movable button 62 moves the first latch into the second closed position, the first hook 63 is able to be releasably connected to the clothing of the user. The carabiner 66 includes a latch 68 pivotally connected to the C-shaped member 67. When the latch is moved into the open position, the carabiner 66 can be attached to the users clothing and when the latch 68 is moved into the closed position the carabiner 66 is releasably secured to the users clothing. The material attachment clip 75 is attached to the users clothing by threading the material attachment clip 75 through the clothing of a user and bringing together the first and second fasteners 80 and 85 thereby releasbly securing the material attachment clip 75 to the user.

At this time the towel is releasably secured to the clothing of the user via a clasp mechanism. The user now has the towel provided in a readily available position for use without having to travel back to a central location in order to use the towel. The towel may then be used to wipe the face of the user or to clean an item such as a golf ball or club. When the towel is dirty or needs cleaning, the towel may be released from engagement with the clasp and cleaned in any washing machine device. Once cleaned, the towel may be reconnected to the clasp as described above.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A towel attachment device comprising:

a) a first material member having a rectangular shape with first, second, third and fourth sides, wherein said first material member includes an eyelet extending through said first material member positioned adjacent to a first corner of said first member between first and second sides of said first material member;

b) a carabiner having a C-shaped member and a latch pivotally connected to said C-shaped member wherein said latch is moveable from a first open position to a second closed position, and upon said latch being in said first open position, said C-shaped member passes through said eyelet and further through a recess in an article of clothing of a user thereby securing said towel to the article of clothing; and c) a second material member smaller than said first material member having a rectangular shape located at a corner of said first material member diagonally opposite said first corner and connected along a first edge thereof to said first material member, said first edge being parallel to and approximately equi-spaced between said first and third sides of said first material member wherein said second material member is pivotable about said connection to move towards and away from said first material member, and said first edge of said second material member extending from the fourth side of said first material member, wherein said first and second material members form a club cloth for selectively cleaning an object therebetween and, wherein said second material member is further connected to said first member along a second edge thereof adjacent to said first edge not along a side of said first material member so that unattached edges of said second material member are aligned with said third and fourth sides of said first material member, thereby forming a flap with two adjacent sides attached to said first material member.

* * * * *